US007773868B2

(12) United States Patent
Moore

(10) Patent No.: US 7,773,868 B2
(45) Date of Patent: Aug. 10, 2010

(54) METHOD AND SYSTEM FOR RECIRCULATING HOT WATER

(76) Inventor: Lyndal Moore, 22052 W. 66th St., Shawnee, KS (US) 66226

( * ) Notice: Subject to any disclaimer, the term of this patent is extended or adjusted under 35 U.S.C. 154(b) by 294 days.

(21) Appl. No.: 11/972,931

(22) Filed: Jan. 11, 2008

(65) Prior Publication Data

US 2009/0180768 A1 Jul. 16, 2009

(51) Int. Cl.
*F24H 1/10* (2006.01)

(52) U.S. Cl. ..... 392/490; 392/441; 392/465; 122/14.3

(58) Field of Classification Search ..... 392/490, 392/465, 441

See application file for complete search history.

(56) References Cited

U.S. PATENT DOCUMENTS

| | | | | |
|---|---|---|---|---|
| 4,977,885 | A * | 12/1990 | Herweyer et al. | 122/14.31 |
| 7,460,769 | B2 * | 12/2008 | Ryks | 392/490 |
| 2008/0152331 | A1 * | 6/2008 | Ryks | 392/490 |
| 2008/0197205 | A1 * | 8/2008 | Ene et al. | 237/19 |
| 2008/0265046 | A1 * | 10/2008 | Grimes | 237/19 |

* cited by examiner

*Primary Examiner*—Thor S Campbell
(74) *Attorney, Agent, or Firm*—Hovey Williams LLP

(57) ABSTRACT

A method of delivering hot water to a water fixture in which a supplemental hot water heater is installed before the cold water inlet of a tankless hot water heater. The supplemental hot water heater is used to recirculate heated water through the tankless hot water heater at a flow rate below the minimum flow rate of the tankless hot water heater (the flow rate at which the tankless heater's heating element is activated) so that water entering the tankless hot water heater is pre-heated by the supplemental hot water heater without activating the heating element of the tankless hot water heater.

14 Claims, 2 Drawing Sheets

METHOD AND SYSTEM FOR RECIRCULATING HOT WATER

BACKGROUND

1. Field

The present invention relates to hot water recirculation systems. More particularly, the invention relates to a method and system for reducing the "cold water sandwich effect" of tankless hot water heaters.

2. Description of the Related Art

High energy costs and Increased public awareness of global warming and other environmental concerns have encouraged consumers to conserve energy to both decrease their environmental impact and to lower their utility bills. Most individuals can make the greatest difference in their energy consumption by reducing home energy use. The U.S. Department of Energy estimates that water heating accounts for approximately 13% of a typical house's energy requirements. Conventional hot water heaters are inefficient because they heat and store hot water in tanks even when no hot water is being used. Such inefficiencies are commonly referred to as stand-by heat losses. The stand-by heat loss for a typical hot water heater has been estimated to be approximately 50%. Conventional hot water heaters also radiate heat which must be offset by increased air conditioner operation in the summer, further increasing utility bills.

Many consumers are therefore replacing conventional hot water heaters with tankless water heaters. Tankless water heaters directly heat water on-demand, as it is required, and have no storage tanks, thus eliminating stand-by heat losses. Tankless hot water heaters also can deliver hot water to a faucet, shower head, or other water fixture more quickly because they are much smaller than conventional hot water heaters and can therefore be positioned closer to the fixtures. When a hot water heater is positioned closer to a water fixture, there is less piping between the hot water heater and the fixture and therefore less cold water in the pipes that must be discharged before hot water reaches the fixture. Because tankless water heaters have no storage tanks, they can often be installed in cabinets adjacent to water fixtures, thus delivering hot water to the fixtures nearly instantaneously. This reduces wasted water and idle time waiting for the hot water.

Unfortunately, tankless hot water heaters suffer from a phenomenon called the "cold water sandwich effect." This term describes the introduction of cold water into a fixture's hot water supply line during on/off operation of a tankless water heater. The cold water sandwich effect, when present, appears as a momentary drop in hot water temperature as it is discharged from the water fixture.

The cold water sandwich effect is inherent in all tankless water heaters and is a result of their operating principles. Tankless water heaters generally operate as follows: 1) when a hot water fixture is turned on, a water flow sensor in a tankless heater senses the water flow through the heater; 2) the flow sensor triggers the water heater's heating element when the flow rate exceeds a pre-set minimum flow rate; 3) the water flow and water temperature are monitored and used to adjust the heating element to maintain a desired output temperature; 4) when water flow ceases or drops below the minimum flow rate, the heating element is turned off. To maintain a safe ignition sequence for gas-fired tankless hot water heaters, steps 1 and 2 typically take up to 10 seconds. During this ignition sequence, a small amount of cold water flows through the water heater. Each time hot water usage is stopped briefly and then started up again, this ignition sequence is repeated, and a small amount of cold water passes through the water heater. Water exiting a tankless water heater that is cold then hot then cold again (or hot, then cold, then hot) forms a "cold water sandwich."

One known solution for the cold water sandwich effect is shown in FIG. 1. A small recirculating system A is installed after the hot water output line B of a tankless water heater. The recirculating system circulates heated water through the hot water supply line C for fixtures D served by the water heater. The recirculating system A includes a small conventional water heater E with a storage tank, an expansion tank F, a return or recirculation line G, and a pump H for recirculating heated water from the small water heater through the hot water supply line and back to the water heater. The water heater E acts as a mixing tank and uses its heating element to heat the water exiting the tankless hot water heater. The water heater also offsets the heat losses from the recirculation line G. The water in the hot water supply line C is always kept hot (or warm) even when the tankless water heater discharges cold water due to the cold water sandwich effect. Although this method solves the cold water sandwich effect, it is not desirable because it requires installation of a water heater, expansion tank, and pump downstream of the hot water output of the tankless hot water heater. This prevents the tankless water heater from being installed right next to a water fixture. Such a system is also difficult and relatively expensive to install.

Another known solution for the cold water sandwich effect is shown in FIG. 2. A recirculating system H is installed so as to recirculate water through the tankless hot water heater itself so that the heating element of the tankless heater keeps the water in the hot water line L warm. The recirculating system H may include a small storage tank I installed on the hot water outlet J of the tankless water heater, a recirculation line K between the hot water line L and the cold water input M of the tankless hot water heater, and a pump N for recirculating water through the tankless hot water heater when no hot water is being used by the fixtures. The storage tank I acts as a mixing tank to blend cold water exiting the tankless water heater with hot water in the tank. This type of system relies on the tankless hot water heater to heat the water in the recirculation loop and can typically only be used if the hot water supply and return lines are a full ¾" in diameter. There are two primary problems with this method. First, tankless hot water heaters have a minimum btu level at which they heat water and therefore often use more energy than is required to keep the water in the hot water line warm. Second, tankless water heaters are not designed to be operated for long periods of time at low flow rates because they require water flow to carry heat away from their heat exchangers. Warm water constantly circulating through the heaters at a low flow rate does not transfer enough heat from the heat exchangers, thus shortening their life.

SUMMARY

The present invention solves the above-described problems and provides a distinct advance in the art of hot water recirculation methods. One embodiment of the invention is a method of delivering hot water to a water fixture in which a supplemental hot water heater is installed before the cold water inlet of a tankless hot water heater. The supplemental hot water heater is used to recirculate heated water through the tankless hot water heater at a flow rate below the minimum flow rate of the tankless hot water heater (the flow rate at which the tankless heater's heating element is activated) so that water entering the tankless hot water heater is pre-heated by the supplemental hot water heater without activating the heating element of the tankless hot water heater.

Another embodiment of the invention is a hot water delivery system comprising: a tankless hot water heater and a supplemental hot water heater. The tankless hot water heater include a cold water inlet for receiving water from a water source, a heating element for heating the water, a hot water outlet for discharging the heated water to a hot water supply line connected to the water fixture, and a flow-actuated switch for activating the heating element whenever water flows through the tankless hot water heater at a rate exceeding a minimum flow rate. The heating element may be one or more gas burners, an electrical heating element, a solar powered device, a geo-thermal device or any other known water heating device. The supplemental hot water heater is configured to be connected to the cold water inlet of the tankless hot water heater and includes a heating element separate from the heating element of the tankless hot water heater. A pump delivers heated water from the supplemental hot water heater to the cold water inlet of the tankless hot water heater at a flow rate below the minimum flow rate of the tankless hot water heater to pre-heat the water entering the tankless hot water heater without triggering the flow-actuated switch and thus the heating element of the tankless hot water heater.

These and other important aspects of the present invention are described more fully in the detailed description below.

BRIEF DESCRIPTION OF THE DRAWING FIGURES

A preferred embodiment of the present invention is described in detail below with reference to the attached drawing figures, wherein.

Figure 1:
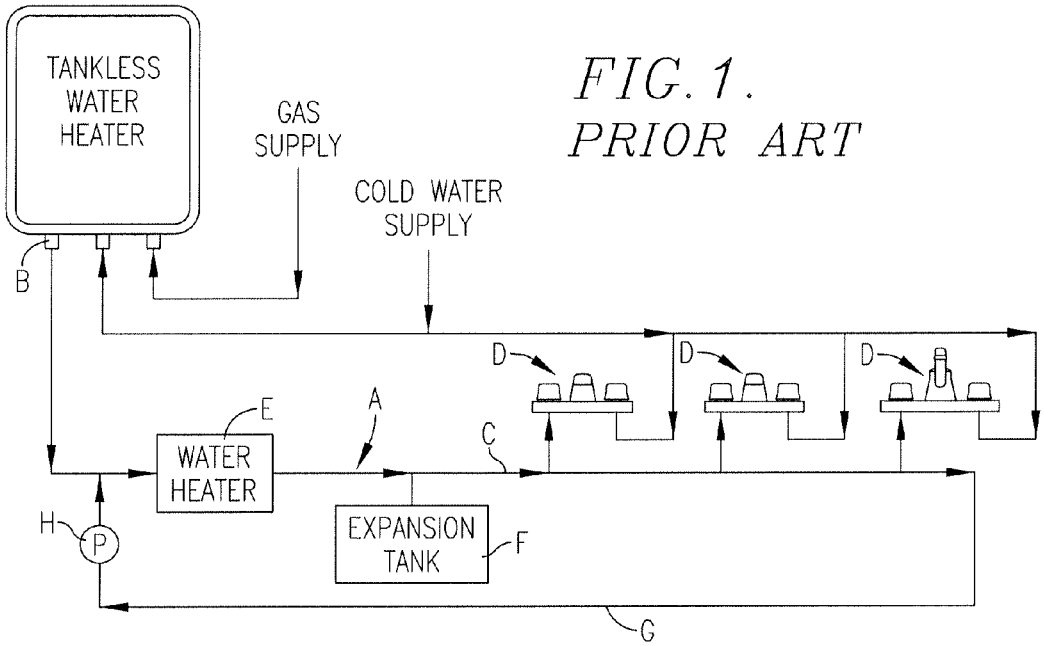
FIG. 1. PRIOR ART
FIG. 1 is a schematic diagram of a plumbing system showing a prior art solution for the cold water sandwich effect of a tankless water heater.
Figure 2:
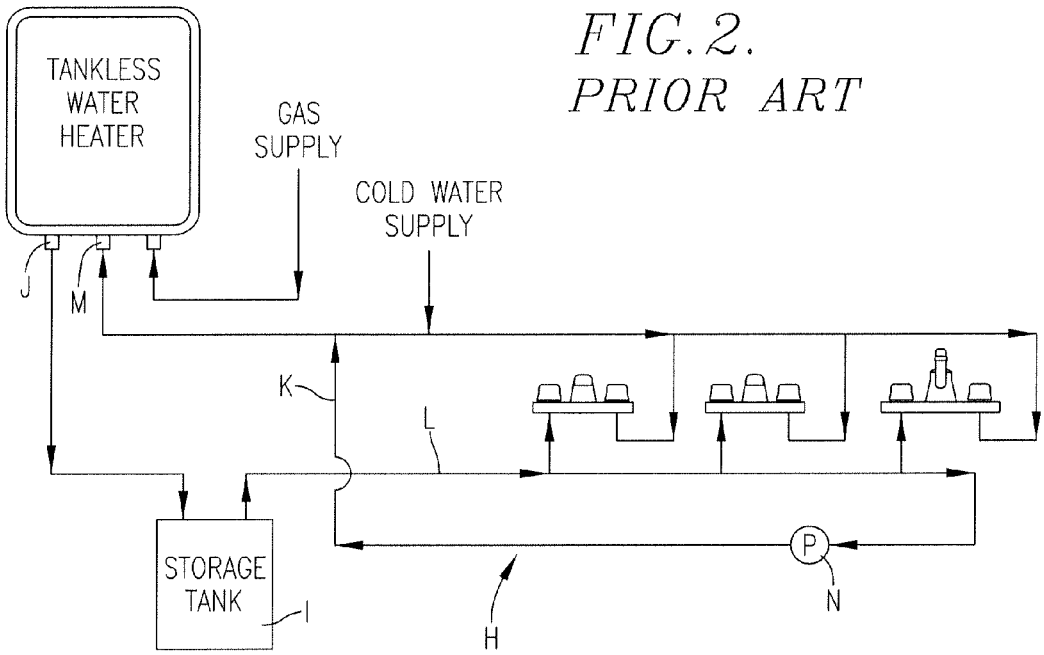
FIG. 2. PRIOR ART
FIG. 2 is a schematic diagram of a plumbing system showing another prior art solution for the cold water sandwich effect of a tankless water heater.

The drawing figures do not limit the present invention to the specific embodiments disclosed and described herein. The drawings are not necessarily to scale, emphasis instead being placed upon clearly illustrating the principles of the invention.

DETAILED DESCRIPTION

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the invention. The following detailed description is, therefore, not to be taken in a limiting sense. The scope of the invention is defined only by the appended claims, along with the full scope of equivalents to which such claims are entitled.

Figure 3:
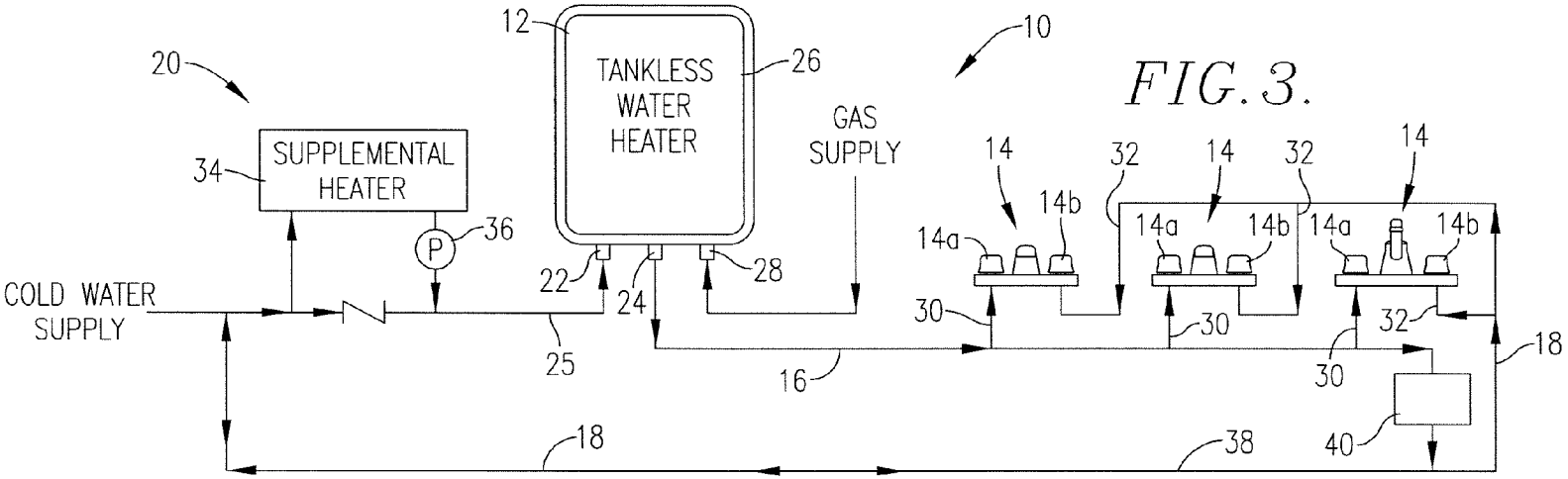
FIG. 3 is a schematic diagram of a plumbing system constructed and arranged in accordance with an embodiment of the present invention.

Turning now to the drawing figures, and particularly FIG. 3, a plumbing system 10 constructed and arranged in accordance with an embodiment of the invention is illustrated. The plumbing system 10 broadly includes a tankless water heater 12, one or more water fixtures 14, a hot water supply line 16 for delivering heated water to the water fixtures, a cold water supply line 18 for delivering unheated water to the water fixtures, and a recirculation system generally referred to by 20 for reducing or eliminating the cold water sandwich effect of the tankless water heater. The plumbing system 10 may be a portion of a residential, commercial, industrial, or other type plumbing system and may include other conventional components such as directional valves, shut-off valves, pressure relief valves, expansion tanks, and other components common to plumbing systems.

In more detail, the tankless water heater 12 may be any conventional tankless water heater such as those manufactured and sold by Rinnai, Noritz, Takagi, or Paloma. The tankless water heater 12 includes a cold water inlet 22, a heating element, a hot water outlet 24, and a flow actuated switch all housed within an enclosure 26 which can be mounted to a wall, stud, cabinet, or any other support structure. The cold water inlet 22 receives water from a water source such as a main water line, water tank, or well. The heating element heats the water received at the cold water inlet 22 and may be one or more gas burners, an electrical heating element, a solar powered device, a geo-thermal device or any other known water heating device. If the tankless water heater 12 is gas-fired, it also includes a gas inlet 28 for receiving natural gas or propane from an appropriate source. If the heater 12 is electrical, power would be provided through an appropriate electricity source. The hot water outlet 24 discharges the heated water to the hot water supply line 16 which in turn delivers it to the water fixtures 14. The flow actuated switch within the tankless hot water heater senses the flow of water through the tankless hot water heater and activates the heating element whenever the water flow rate exceeds a minimum flow rate. A minimum flow rate is required to ensure sufficient water flow to remove heat from the heat exchangers and to prevent overheating of the water. The minimum flow rate may be anywhere between 0.1 and 1.5 gallons per minute and in an exemplary embodiment is approximately 0.5 gallons per minute.

The water fixtures 14 are entirely conventional and may be faucets, showerheads, washing machine hook-ups, dishwasher hook-ups, or any other water delivery mechanism. Each fixture 14 may include a hot side 14*a* and a cold side 14*b*. The hot water sides of the water fixtures may be connected to the hot water supply line 16 by hot water branch lines 30. The hot water supply line 16 and the branch lines 30 may consist of a pipe or series of pipes, hoses, or any other fluid-carrying conduits which can deliver hot water from the tankless water heater 12 to hot water fixtures. The illustrated hot water supply line 16 may be a portion of a longer hot water supply line which delivers hot water to other water fixtures in a house or other building.

The cold water supply line 18 may also consist of a pipe or a series of pipes, hoses, or other fluid-carrying conduits. The cold water supply line 18 delivers unheated water to cold water branch lines 32 connected to the cold sides 14*b* of the water fixtures. As with the hot water supply line 16, the illustrated cold water supply line 18 may be a portion of a longer cold water supply line which delivers cold water to many other fixtures in a house or other building. As discussed in more detail below, the cold water supply line 18 also serves as a recirculation line for the recirculation system 20.

The recirculation system 20 is provided for reducing or eliminating the cold water sandwich effect of the tankless hot water heater 12. As explained in more detail below, an important aspect of the recirculation system 20 is that it circulates heated water through the tankless hot water heater at a flow rate below the tankless water heater's minimum flow rate to prevent triggering of the heating element within the tankless hot water heater.

In more detail, the recirculation system 20 includes a supplemental hot water heater 34, a pump 36, and a recirculation line 38. The supplemental water heater 34 receives unheated water from the cold water supply line 18, heats the water, then delivers it to the cold water inlet 22 of the tankless water heater 12. The supplemental hot water heater may be any type of water heater but is preferably a small capacity electric or gas-fired hot water heater with a small water storage tank. The particular btu rating and storage capacity of the supplemental hot water heater 34 may vary depending on the size of the plumbing system 10. For example, a large building with a greater number of water fixtures may require a larger capacity supplemental hot water heater than a small house with a smaller number of water fixtures.

The pump 36 is also conventional and is configured for pumping heated water in a loop between the supplemental hot water heater 34, the tankless hot water heater 12, and back to the supplemental water heater 34. The pump 36 is sized and/or controlled so as to pump water through the tankless hot water heater at a flow rate below the minimum flow rate of the tankless hot water heater. For example, if the minimum flow rate of the tankless hot water heater is 0.5 gallons per minute, the pump may be sized and/or controlled so as to pump water at a rate of 0.3 gallons per minute.

The supplemental hot water heater 34 and pump 36 may also be a single component. For example, the pump 36 may include an integral heating element which heats water as it passes through the pump so that a separate supplemental hot water heater is not required. Similarly, the supplemental hot water heater 34 may include an integral pump so that a separate pump is not required.

The recirculation line 38 of the embodiment shown in FIG. 3 is provided in part by the cold water supply line 18. A temperature actuated bypass valve 40 connects the cold water supply line 18 to the hot water supply line 16. The valve 40 opens to maintain warm water at hot water outlets 14*a* by recirculating water through the inlet of the supplemental water heater 34 through the cold water supply line 18 wherever cold water is not being delivered to the cold water sides 14*b* of the water fixtures. The temperature actuated bypass valve 40 may be positioned at the water fixture that is farthest from the tankless hot water heater. Using the cold water supply line as a recirculation line for the recirculation system 20 eliminates the need to install a separate return loop from the end of the hot water supply line back to the supplemental hot water heater. The system may contain more than one bypass valve to maintain the recirculation loop temperature at a desired level.

The plumbing system of FIG. 3 generally operates as follows: The supplemental hot water heater 34 heats and stores water in a conventional fashion. The pump 36 pumps heated water in a loop from the supplemental hot water heater 34 through the cold water inlet 22 of the tankless hot water heater, out the hot water outlet 24 of the tankless hot water heater, through the hot water supply line 16, through the temperature actuated bypass valve 40, through the cold water supply line 18, and back to the supplemental hot water heater 34. The pump 36 may continuously pump heated water through this loop or may be triggered by a timer, temperature sensor, or motion sensor positioned anywhere in the loop to only pump heated water periodically or once the water in the loop drops below a pre-determined temperature.

When a user turns on any of the hot water valves 14*a* of the water fixtures, cold water from the cold water supply line is drawn toward the cold water inlet 22, delivering the pre-heated water in the section of pipes labeled 25 into the inlet 22, thus activating the heating element of the tankless hot water heater. As explained above, water flows through the tankless hot water heater for several seconds before the heating element begins to heat water, but because the water initially delivered to the cold water inlet 22 is preheated by the supplemental hot water heater 34, the water exiting the hot water output 24 is always heated. Moreover, the recirculation system 20 continuously or periodically circulates heated water through the hot water supply line 16 and back to the supplemental hot water heater 34 through return line 38 to keep the water in the hot water supply line 16 heated at all times. Thus, the hot water sides 14*a* of the water fixtures never receive unheated water.

Importantly, the recirculation system 20 is configured to pump water through the tankless hot water heater 12 at a flow rate below the minimum flow rate which triggers the heating element of the tankless hot water heater. Thus, the heating element of the tankless hot water heater is only activated when one of the water fixtures calls for hot water at a rate which exceeds the minimum flow rate. This reduces or eliminates the cold water sandwich effect of the tankless hot water heater without decreasing the life of the tankless hot water heater.

It is important that the piping 25 between the main cold water supply and the tankless hot water heater 12 be sized to hold an adequate volume of pre-heated water for delivery to the tankless hot water heater inlet 12. When the hot water valves 14*a* are operated, the tankless water heater calls for water from the cold water supply. Because the tankless hot water heater does not begin to heat its own water for a few seconds, the volume of pre-heated water delivered to the inlet 22 must meet the hot water demands of the hot water valves 14*a* during this time. For example, an 8.5 GPM tankless hot water heater with a heating element delay of 6 seconds requires 0.85 gallons of pre-heated water at its inlet 22 to prevent the discharge of any cold water. This exemplary 0.85 gallons of pre-heated water may be contained in the pipes connected to the inlet 22 of the tankless hot water heater. Alternatively, the pre-heated water can be supplied directly from the supplemental hot water heater 34, but to do so, the pipes connecting the supplemental heater 34 to the pipes leading to the inlet 22 must be of a large enough diameter to supply the water needs of the hot water valves 14*a*.

Figure 4:
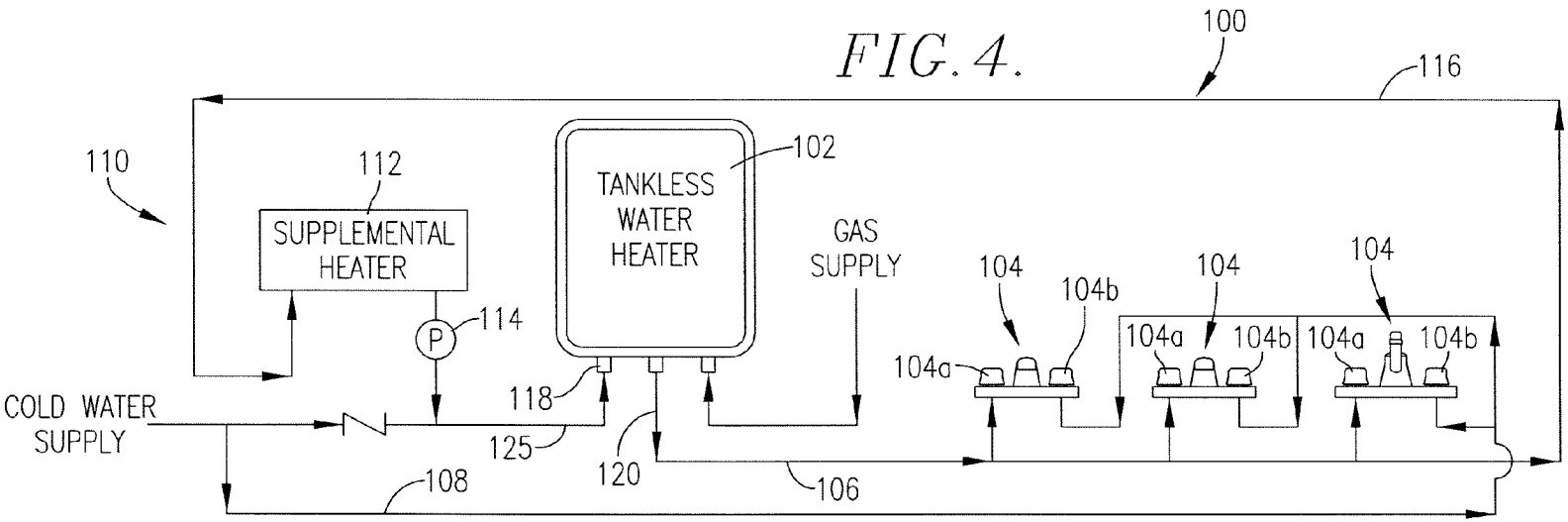
FIG. 4 is a schematic diagram of a plumbing system constructed and arranged in accordance with another embodiment of the present invention.

FIG. 4 illustrates a plumbing system 100 constructed and arranged in accordance with another embodiment of the invention. As with the embodiment of FIG. 3, the plumbing system 100 may be a portion of a residential, commercial, industrial, or other type plumbing system and may include other conventional components such as directional valves, shut-off valves, pressure relief valves, expansion tanks, etc. The main difference between the plumbing system of FIG. 3 and FIG. 4 is the recirculation line.

The plumbing system 100 broadly includes a tankless water heater 102, one or more water fixtures 104, a hot water supply line 106 for delivering heated water to the water fixtures, a cold water supply line 108 for delivering unheated water to the water fixtures, and a recirculation system 110 for reducing or eliminating the cold water sandwich effect of the tankless water heater. The tankless water heater, water fixtures, hot water supply line, and cold water supply line are the same as those described with respect to the embodiment of FIG. 3.

The recirculation system 110 is provided for reducing or eliminating the cold water sandwich effect of the tankless hot water heater. As with the embodiment of FIG. 3, the recirculation system circulates heated water through the tankless hot water heater at a low enough flow rate to prevent triggering of the heating element within the tankless hot water heater.

The recirculation system 110 is similar to the recirculation system 20 of the embodiment of FIG. 3 and includes a supplemental hot water heater 112, a pump 114, and a recirculation line 116. The supplemental water heater 112 receives water from the recirculation line 116, maintains its temperature, then delivers it to the cold water inlet 118 of the tankless water heater. Thus, the water in the piping section 125 is warm when it is delivered to the inlet 118 when the hot water valves 104*a* call for hot water. The supplemental hot water heater may be any type of water heater but is preferably a small capacity electric or gas-fired hot water heater with a small water storage tank. The particular btu rating and storage capacity of the supplemental hot water heater may vary depending on the size of the plumbing system.

The pump 114 is also conventional and is configured for pumping heated water in a loop between the supplemental hot water heater 112, the tankless hot water heater 102, and back to the supplemental water heater 112. The pump is sized and/or controlled so as to pump water through the tankless hot water heater at a flow rate that is below the minimum flow rate of the tankless hot water heater. The pump 114 can be located elsewhere in the recirculation system 110.

The supplemental hot water heater and pump may also be a single component. For example, the pump may include an integral heating element which heats water as it passes through the pump so that a separate supplemental hot water heater is not required. Similarly, the supplemental hot water heater may include an integral pump so that a separate pump is not required.

The recirculation line 116 of the embodiment shown in FIG. 4 is a pipe, series of pipes, or other fluid-carrying conduit connected between the end of the hot water supply line 106 and the inlet of the supplemental water heater 112. The line 116 may be of any size but is preferably at least ½" in diameter.

The plumbing system 100 of FIG. 4 generally operates as follows: The supplemental hot water heater 112 heats and stores water in a conventional fashion. The pump 114 pumps heated water in a loop from the supplemental hot water heater 112 through the cold water inlet 118 of the tankless hot water heater, out the hot water outlet 120 of the tankless hot water heater, through the hot water supply line 106, through the recirculation line 116, and back to the supplemental hot water heater 112. The pump 114 may continuously pump heated water through this loop or may be triggered by a timer, temperature sensor, or motion sensor positioned anywhere in the loop to only pump heated water periodically or once the water in the loop drops below a pre-determined temperature.

When a user turns on any of the hot water valves 104*a* of the water fixtures, cold water from the cold water supply line is drawn toward the cold water inlet 118, delivering the preheated water in the section of pipes labeled 125 into the inlet 118, thus activating the heating element of the tankless hot water heater. As explained above, water flows through the tankless hot water heater for several seconds before its heating element begins to heat water, but because the water delivered to the cold water inlet 22 is preheated by the supplemental hot water heater 34, the water exiting the hot water output 24 is always heated. Moreover, the recirculation system 110 continuously or periodically circulates heated water through the hot water supply line 106 and back to the supplemental hot water heater 112 through the return line to keep the water in the hot water supply line heated at all times. Thus, the hot water sides of the water fixtures never receive unheated water.

As with the previous embodiment, the recirculation system 110 of FIG. 4 is configured to pump water through the tankless hot water heater 102 at a flow rate below the tankless hot water heater's minimum flow rate. Thus, the tankless hot water heater is only activated when one of the water fixtures calls for hot water at a rate which exceeds the minimum flow rate. This reduces or eliminates the cold water sandwich effect of the tankless hot water heater without decreasing the life of the tankless hot water heater.

Although the invention has been described with reference to the preferred embodiment illustrated in the attached drawing figures, it is noted that equivalents may be employed and substitutions made herein without departing from the scope of the invention as recited in the claims.

Having thus described the preferred embodiment of the invention, what is claimed as new and desired to be protected by Letters Patent includes the following:

1. A method of delivering hot water to a water fixture, the method comprising:

installing a tankless hot water heater between the water fixture and a water source, the tankless hot water heater including a heating element having a minimum flow rate at which it begins to heat water;

connecting a supplemental hot water heater to the tankless hot water heater; and recirculating water heated by the supplemental hot water heater through the tankless hot water heater at a flow rate below the minimum flow rate of the tankless hot water heater so that water entering the tankless hot water heater is pre-heated by the supplemental hot water heater without activating the heating element of the tankless hot water heater.

2. The method as set forth in claim 1 wherein the recirculating step is performed with a pump having a flow rate below the minimum flow rate of the tankless hot water heater.

3. The method as set forth in claim 2, wherein the minimum flow rate is between 0.1-1.5 gallons per minute.

4. The method as set forth in claim 2, wherein the minimum flow rate is approximately 0.5 gallons per minute.

5. The method as set forth in claim 1, wherein the recirculating step is performed by pumping water from the supplemental hot water heater to a cold water inlet of the tankless hot water heater, out a hot water outlet of the tankless hot water heater, through a hot water supply line connected between the tankless hot water heater and the water fixture, through a recirculation line connected between the hot water supply line and the supplemental hot water heater, and back to the supplemental hot water heater.

6. The method as set forth in claim 1, wherein the recirculating step is performed by pumping water from the supplemental hot water heater to a cold water inlet of the tankless hot water heater, out a hot water outlet of the tankless hot water heater, through a hot water supply line connected between the tankless hot water heater and the water fixture, through a bypass valve between the hot water supply line and a cold water supply line, through the cold water supply line, and back to the supplemental hot water heater.

7. A method of delivering hot water to a water fixture, the method comprising:

heating water in a supplemental hot water heater; and recirculating the water heated by the supplemental hot water heater through a tankless hot water heater at a flow rate below a minimum flow rate of the tankless hot water heater so that the water entering the tankless hot water heater is pre-heated by the supplemental hot water heater without activating a heating element of the tankless hot water heater.

8. The method as set forth in claim 7, wherein the recirculating step is performed with a pump having a flow rate below the minimum flow rate of the tankless hot water heater.

9. The method as set forth in claim 7, wherein the minimum flow rate is between 0.1-1.5 gallons per minute.

10. The method as set forth in claim 8, wherein the minimum flow rate is approximately 0.5 gallons per minute.

11. The method as set forth in claim 7, wherein the recirculating step is performed by pumping water from the supplemental hot water heater to a cold water inlet of the tankless hot water heater, out a hot water outlet of the tankless hot water heater, through a hot water supply line connected between the tankless hot water heater and the water fixture, through a recirculation line connected between the hot water supply line and the supplemental hot water heater, and back to the supplemental hot water heater.

12. The method as set forth in claim 7, wherein the recirculating step is performed by pumping water from the supplemental hot water heater to a cold water inlet of the tankless hot water heater, out a hot water outlet of the tankless hot water heater, through a hot water supply line connected between the tankless hot water heater and the water fixture, through a bypass valve between the hot water supply line and a cold water supply line, through the cold water supply line, and back to the supplemental hot water heater.

13. A hot water delivery system for delivering hot water to a water fixture, the system comprising:

a tankless hot water heater including— a cold water inlet for receiving water from a water source, a heating element for heating the water, a hot water outlet for discharging the heated water to a hot water supply line connected to the water fixture, and a flow-actuated switch for activating the heating element whenever water flows through the tankless hot water heater at a rate exceeding a minimum flow rate;

a supplemental hot water heater operable to be connected to the cold water inlet of the tankless hot water heater; and a pump for circulating heated water from the supplemental hot water heater through the tankless hot water heater at a flow rate below the minimum flow rate of the tankless hot water heater.

14. The system as set forth in claim 13, further including a bypass valve for installation between the hot water supply line and a cold water supply line for use in returning heated water back to the supplemental hot water heater.

* * * * *